US005496241A

United States Patent [19]

Sellers

[11] Patent Number: 5,496,241

[45] Date of Patent: Mar. 5, 1996

[54] EXERCISE MACHINE

[76] Inventor: Tyrone D. Sellers, 1409 Columbia Ter., Peoria, Ill. 61606

[21] Appl. No.: 279,911

[22] Filed: Jul. 25, 1994

[51] Int. Cl.[6] ..... A63B 22/00; A63B 21/015; A63B 69/06; A63B 69/18

[52] U.S. Cl. ..... 482/51; 482/53; 482/64; 482/70; 482/73; 482/110; 482/119; 482/123; 482/142

[58] Field of Search ..... 482/52, 53, 62, 482/64, 70–73, 123, 130, 138, 142, 145, 904, 51, 57, 110, 114, 119

[56] References Cited

U.S. PATENT DOCUMENTS

| | | | |
|---|---|---|---|
| 3,387,843 | 6/1968 | Chandler . | |
| 3,494,616 | 2/1970 | Parsons . | |
| 3,966,201 | 6/1976 | Mester . | |
| 4,023,795 | 5/1977 | Pauls . | |
| 4,072,309 | 2/1978 | Wilson . | |
| 4,082,264 | 4/1978 | Santos . | |
| 4,140,312 | 2/1979 | Buchmann | 482/62 |
| 4,257,593 | 3/1981 | Keiser . | |
| 4,479,646 | 10/1984 | Beistegui Chirapozu | 482/62 |
| 4,509,742 | 4/1985 | Cones . | |
| 4,537,396 | 8/1985 | Hooper . | |
| 4,564,193 | 1/1986 | Stewart . | |
| 4,684,121 | 8/1987 | Nestegard . | |
| 4,705,267 | 11/1987 | Jackson . | |
| 4,709,918 | 12/1987 | Grinblat | 482/70 |
| 4,709,923 | 12/1987 | Gibson . | |
| 4,717,148 | 1/1988 | Brewer . | |
| 4,728,101 | 3/1988 | King . | |
| 4,733,858 | 3/1988 | Lan | 482/53 |
| 4,792,135 | 12/1988 | Chin-Sen . | |
| 4,796,882 | 1/1989 | Jiumr . | |
| 4,801,139 | 1/1989 | Vanhoutte et al. . | |
| 4,856,775 | 8/1989 | Colledge et al. . | |
| 4,880,227 | 11/1989 | Sowell . | |
| 4,911,436 | 3/1990 | Lighter . | |
| 4,934,695 | 6/1990 | Wolff . | |
| 5,090,694 | 2/1992 | Pauls et al. . | |
| 5,108,093 | 4/1992 | Watterson . | |
| 5,110,118 | 5/1992 | Winey . | |
| 5,112,287 | 5/1992 | Brewer | 482/123 |
| 5,135,458 | 8/1992 | Huang . | |
| 5,160,305 | 11/1992 | Lin | 482/138 |
| 5,195,937 | 3/1993 | Engel et al. . | |
| 5,290,211 | 3/1994 | Stearns | 482/53 |
| 5,299,992 | 4/1994 | Wilkinson . | |
| 5,401,226 | 3/1995 | Stearns | 482/53 |

FOREIGN PATENT DOCUMENTS

| | | | |
|---|---|---|---|
| 8601735 | 3/1986 | WIPO | 482/71 |

*Primary Examiner*—Richard J. Apley
*Assistant Examiner*—Victor K. Hwang
*Attorney, Agent, or Firm*—Rogers, Howell & Haferkamp

[57] ABSTRACT

An exercise machine of the present invention is transformable between a first mode for simulating an activity such as skiing or rowing involving reciprocating linear motion and a second mode for simulating a cycling activity. The exercise machine comprises a frame, a shaft operatively connected to the frame for rotation about a shaft axis, a flywheel secured to the shaft and rotatable therewith, and a runner. A drive roller is operatively connected to the frame and is engageable with the runner such that forward or rearward movement of the runner causes the drive roller to rotate. A one-way clutch operatively connects the drive roller to the shaft so that the drive roller when rotated in a first direction causes rotation of the flywheel, and is free wheeling when rotated in a second opposite direction. A pair of offset cranks are operatively connectable to the shaft and a pair of foot pedals are connected to the cranks. The exercise machine is operable in the first mode such that rearward movement of the runner causes rotation of the flywheel and forward movement of the runner rotates the roller independent of the rotation of the flywheel. Rotation of the cranks in the first mode causes rotation of the flywheel.

20 Claims, 12 Drawing Sheets

82
238
198
206
192
238
X4
30
246
240
242
244
132
118
182
184
180
186
58
130
102
56
206
188
190
176
42
236
32
262
266
250
250a
162
158
202
164
146
174
254
12
12
222
194
172
62
80
94
72
74
76
100
192
82
86
120
44
160
204

EXERCISE MACHINE

BACKGROUND OF THE INVENTION

The present invention relates generally to exercise machines, and more particularly to an exercise machine for performing several different exercises.

This invention represents an improvement on prior exercise machines. These prior machines have various drawbacks. Some are expensive to manufacture; some are not capable of being used to perform more than one or two different exercises; some are bulky and heavy and not easily transported and stored; and some do not provide true simulations of aerobic activities (e.g., cycling, rowing, skiing, stair climbing). There is a need, therefore, for an improved exercise machine which does not suffer the disadvantages of prior machines.

SUMMARY OF THE INVENTION

Among the several objects of this invention may be noted the provision of an improved exercise machine capable of being used to perform several different exercises; the provision of such a machine for providing true simulations of several aerobic activities including cycling, rowing, cross-country skiing and stair climbing; the provision of such a machine capable of being used to perform weight-training exercises; the provision of such a machine which may be easily transformed among several exercise modes; the provision of such a machine which, when not in use, is relatively compact and lightweight and may be easily stored and transported; and the provision of such a machine which is relatively inexpensive to manufacture.

Briefly, an exercise machine of the present invention is operable in a first mode for simulating an activity such as skiing or rowing involving reciprocating linear motion in a generally horizontal plane and in a second mode for simulating a cycling activity. The machine comprises a frame, a shaft operatively connected to the frame for rotation about a shaft axis, a flywheel secured to the shaft and rotatable therewith, and an elongate member having a longitudinal axis. The elongate member functions as a runner when the machine is operated in the first mode. The runner is mountable on the frame for linear reciprocating movement in a generally horizontal plane along the longitudinal axis of the runner between forward and rearward positions. A drive roller is operatively connected to the frame for rotation about a roller axis. The drive roller is engageable with the runner such that rearward movement of the runner about its longitudinal axis causes rotation of the drive roller in a first direction and forward movement of the runner about its longitudinal axis causes rotation of the drive roller in a second direction opposite the first direction. A one-way clutch operatively connects the drive roller to the shaft. The clutch effects driving engagement between the drive roller and shaft when the drive roller is rotated in the first direction such that rotation of the drive roller in the first direction rotates the flywheel. The clutch effects driving disengagement between the drive roller and shaft when the drive roller is rotated in the second direction such that the drive roller is free wheeling when rotated in the second direction to rotate independently of the flywheel. A pair of offset cranks are operatively connectable to the shaft for rotating the shaft and flywheel about the shaft axis. A pair of foot pedals are connected to the cranks. The exercise machine is operable in the first mode such that rearward movement of the runner along the longitudinal axis of the runner rotates the drive roller in the first direction to rotate the flywheel and forward movement of the runner along the longitudinal axis of the runner rotates the drive roller in the second direction independent of the rotation of the flywheel. The exercise machine is operable in the second mode such that rotation of the cranks and shaft via the foot pedals causes rotation of the flywheel.

In another aspect of the present invention, an exercise machine is operable in a first mode for simulating an activity such as skiing or rowing involving reciprocating linear motion in a generally horizontal plane, and in a second mode for simulating climbing steps. The machine comprises a frame and a pair of elongate members, each having a longitudinal axis. The elongate members function as a pair of runners when the machine is operated in the first mode. The runners are mountable on the frame generally parallel to one another for linear reciprocating movement in a generally horizontal plane along the longitudinal axes of the runners between forward and rearward positions. At least parts of the elongate members function as a pair of steps when the machine is operated in the second mode, each step having a stepping surface generally adjacent a first end of the step. The steps are mountable on the frame for pivoting about a generally horizontal axis to enable a user to move the stepping surfaces between raised and lowered positions.

In yet another aspect of the present invention, an exercise machine is operable in a first model for simulating a cycling activity and operable in a second mode as a weight bench for supporting a user during a weight lifting activity. The machine comprises a frame, a shaft operatively connected to the frame for rotation about a shaft axis, a flywheel secured to the shaft and rotatable therewith, a pair of offset cranks operatively connectable to the shaft for rotating the shaft and flywheel about the shaft axis, and a pair of foot pedals connected to the cranks. The frame includes a base structure and an elongate support. The elongate support has first and second opposite ends and an intermediate portion between the ends. The elongate support is connected at its first end to the base structure for pivoting about a generally horizontal axis between an upright position in which the second end is above the first end and a generally horizontal position. The elongate support is in its upright position when the machine is operated in the first mode and is in its generally horizontal position when operated in the second mode. A saddle is mountable on the second end of the elongate support when the support is in its upright position. The saddle is adapted to support a user when the machine is operated in its first mode. A pad is mounted on the intermediate portion of the elongate support and has a surface which faces upwardly when the support is in its generally horizontal position. The support and pad function as a weight bench to support a user performing weight lifting exercises when the machine is operated in its second mode.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
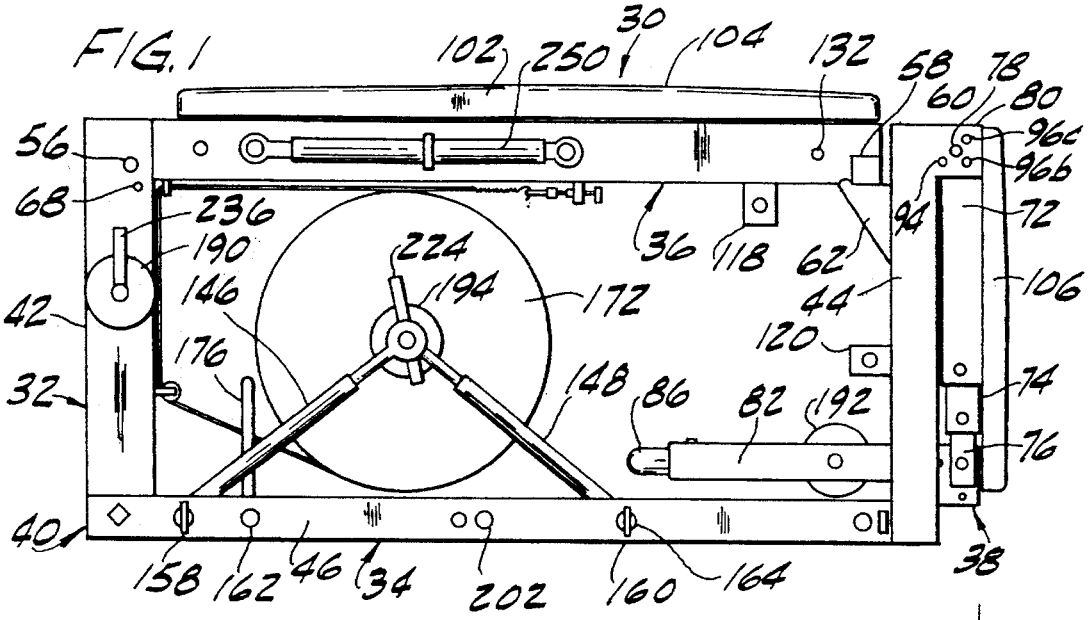
FIG. 1 is a side elevational view of an exercise machine of this invention in a compact storage mode.
Figure 2:
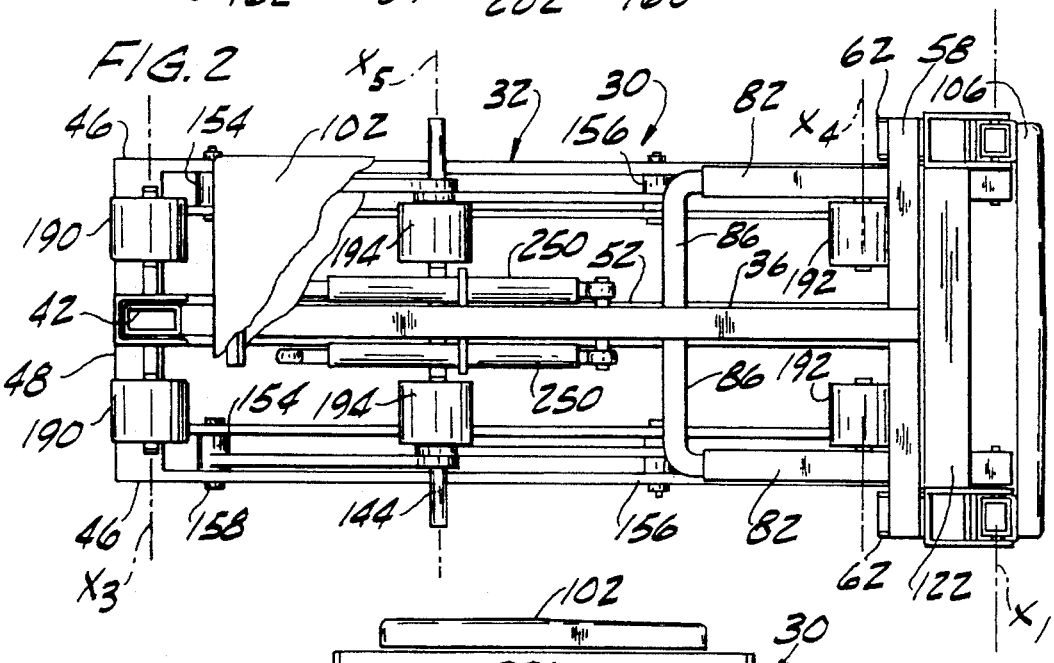
FIG. 2 is a bottom plan view of the exercise machine of FIG. 1 with portions broken away to show detail.
Figure 3:
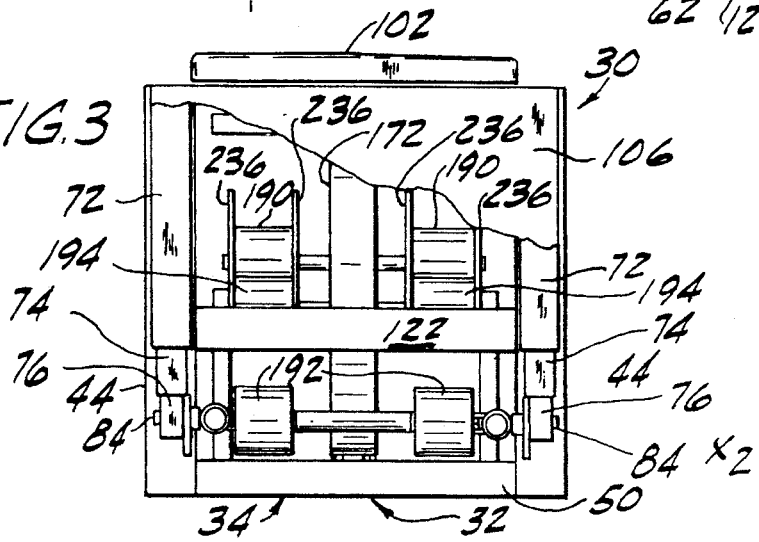
FIG. 3 is a rear (right) end view of the exercise machine of FIG. 1 with portions broken away to show detail.

Referring now to the drawings, and first more particularly to FIGS. 1–3, an exercise machine of the present invention is indicated in its entirety by the reference numeral 30. The exercise machine 30 is shown in a compact mode in FIGS. 1–3 for storage or transport. As discussed in detail below, it may be transformed from the compact mode to several different exercise modes, including a weight bench mode, a cycling mode, a skier mode, a rowing mode, and a stair stepper mode.

The exercise machine 30 includes a frame, generally indicated at 32, having a base structure, generally indicated at 34, an elongate support, generally indicated at 36, and a foldable structure, generally indicated at 38. The base structure 34 comprises a bottom portion, generally indicated at 40, a forward post 42, and two rear posts 44. The bottom portion 40 has two parallel channels 46, a forward cross-beam 48 extending between forward ends of the channels (left ends as viewed in FIGS. 1 and 2), a rear cross-beam 50 extending between rear ends of the channels (right ends as viewed in FIGS. 1 and 2), and an intermediate beam 52 generally midway between the channels and extending longitudinally between the cross-beams. The forward post 42 extends upward from the forward cross-beam 48, generally midway between the channels 46. The rear posts 44 extend upward from opposite ends of the rear cross-beam.

Figure 6:
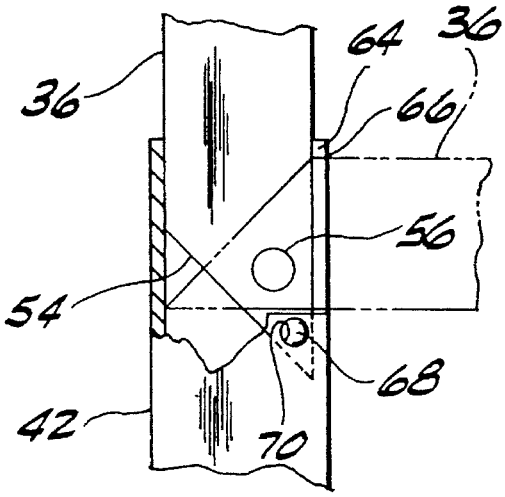
FIG. 6 is a fragmented side elevational view of an elongate support of the exercise machine pivotally connected to a forward post of the exercise machine.
Figure 7:
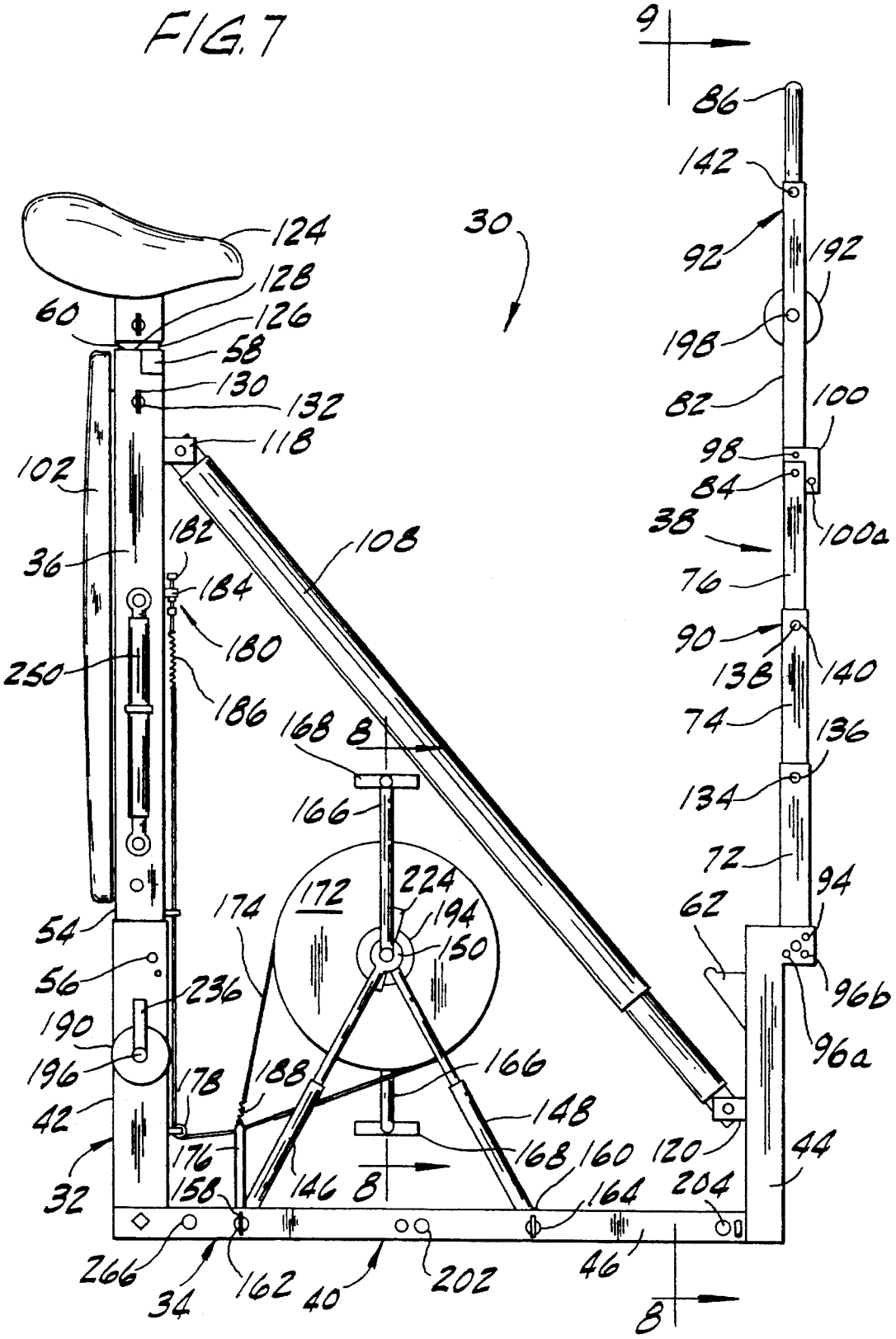
FIG. 7 is a side elevational view of the exercise machine of FIG. 1 transformed into a cycling mode for simulating a cycling activity.

A first (pivot) end 54 of the elongate support 36 is pin-connected at 56 to the forward post 42 for allowing the elongate support to pivot about a horizontal axis between a generally horizontal position (FIGS. 1 and 4) and a generally vertical upright position (FIG. 7). A cross-bar 58 is securely fixed generally at its midpoint to a second. (free) end 60 of the elongate support 36 and extends laterally therefrom. End margins of the cross-bar 58 are engageable with stops 62 fixed to the rear posts 44. The cross-bar 58 and stops 62 maintain the elongate support 36 in its horizontal position. As shown in FIG. 6, a cutaway 64 is formed at the upper end of the forward post 42 in a rear wall 66 thereof and the pivot end 54 of the elongate support 36 is mitered at approximately 45 degrees. When the elongate support 36 is in its raised position, a forward wall portion of the elongate support engages a forward wall of the forward post 42 and a rear wall portion of the elongate support engages the rear wall of the forward post to prevent counterclockwise rotation of the elongate support beyond its raised position. Lock buttons 68 (only one of which is shown in FIG. 6) are in the side walls of the elongate support 36 and are adapted to extend through holes 70 in the forward post 42 to releasably lock the elongate support in its raised position.

The foldable structure 38 has two parallel sets of telescoping tubes. Each set has an outer tube 72, a middle tube 74 slidable within the outer tube, and an inner tube 76 slidable within the middle tube. The outer tubes 72 are pin-connected at 78 to flanges 80 extending rearwardly from an upper end of one the rear posts 44 for pivoting about a generally horizontal axis $X_1$ (FIG. 2). Two sleeves 82 are pin-connected at 84 to ends of the inner tubes 76 (rearwardly extending ends as viewed in FIG. 4) for pivoting of the sleeves about a generally horizontal axis $X_2$. A U-shaped tubular member 86 is connected to the sleeves 82 and has arms 88 telescopingly interfitted in the sleeves. The parallel sets of telescoping tubes constitute a first part, generally indicated at 90, of the foldable structure 38; the sleeves and the U-shaped member constitute a second part, generally indicated at 92, of the foldable structure.

Figure 4:
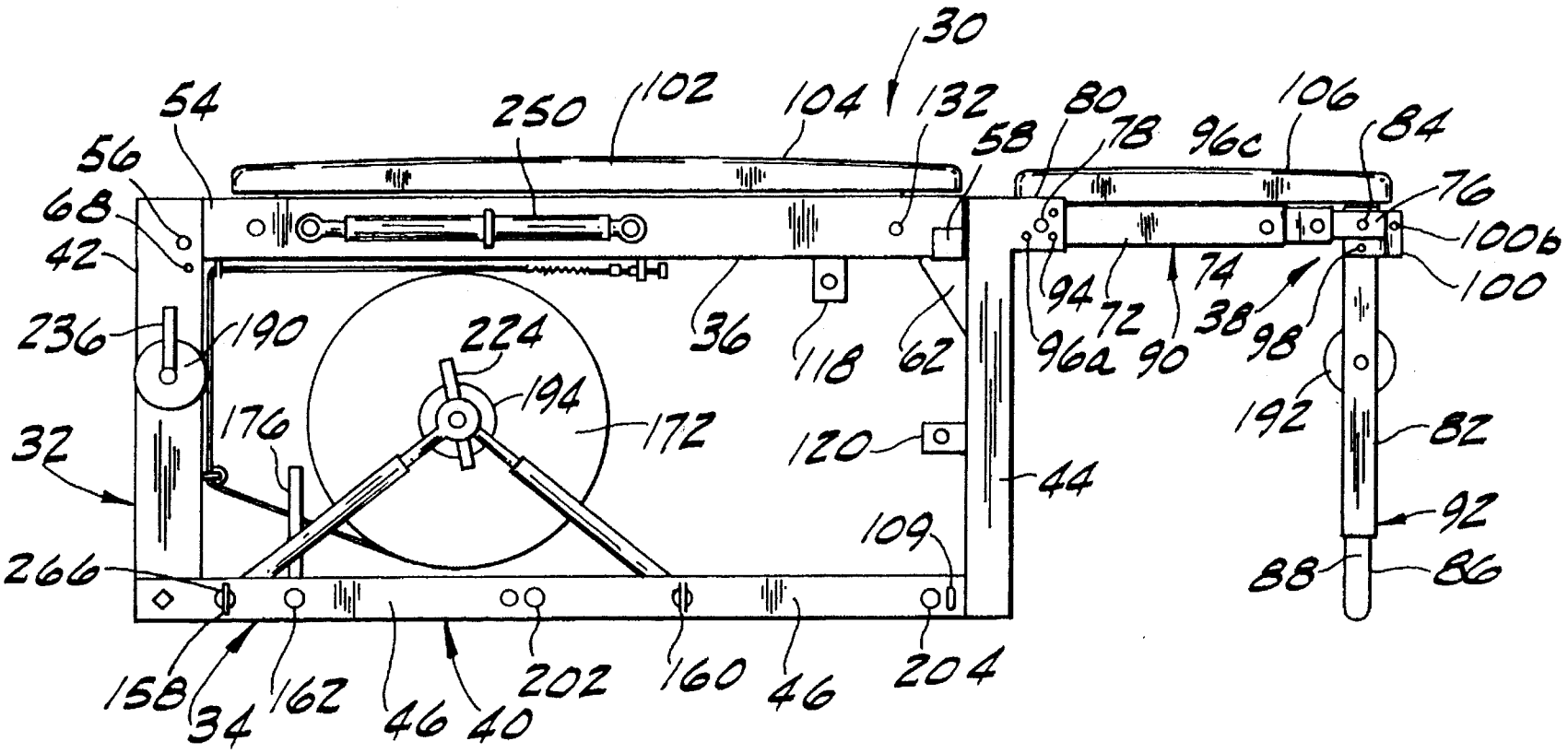
FIG. 4 is a side elevational view of the exercise machine of FIG. 1 transformed into a weight bench mode.

The lower ends of the outer tubes 72 have conventional lock buttons 94 on side walls of the outer tubes. Each lock button 94 is adapted to releasably engage first, second and third holes 96*a*, 96*b*, 96*c* in the flanges 80 of the rear posts 44. When the lock buttons 94 are aligned with and extend through the first holes 96*a*, the telescoping tubes are releasably locked in a downwardly extending position (FIG. 1). When the lock buttons 94 are aligned with and extend through the second holes 96*b*, the telescoping tubes are releasably locked in a rearwardly extending position (FIG. 4). When the lock buttons 94 are aligned with and extend through the third holes 96*c*, the telescoping tubes are releasably locked in an upwardly extending position (FIG. 7). The lower ends of the sleeves 82 also have conventional lock buttons 98 therein. Each lock button 98 is adapted to releasably engage first and second holes 100*a*, 100*b* in flanges 100 secured to the upper ends of the inner tubes 76. When the lock buttons 98 are aligned with and extend through the first holes 100*a*, the sleeves 82 are releasably locked in a position generally perpendicular to the telescoping tubes (FIG. 4). When the lock buttons 98 are aligned with and extend through the second holes 100*b*, the sleeves are releasably locked in a position aligned with the telescoping tubes (FIG. 7).

Figure 5:
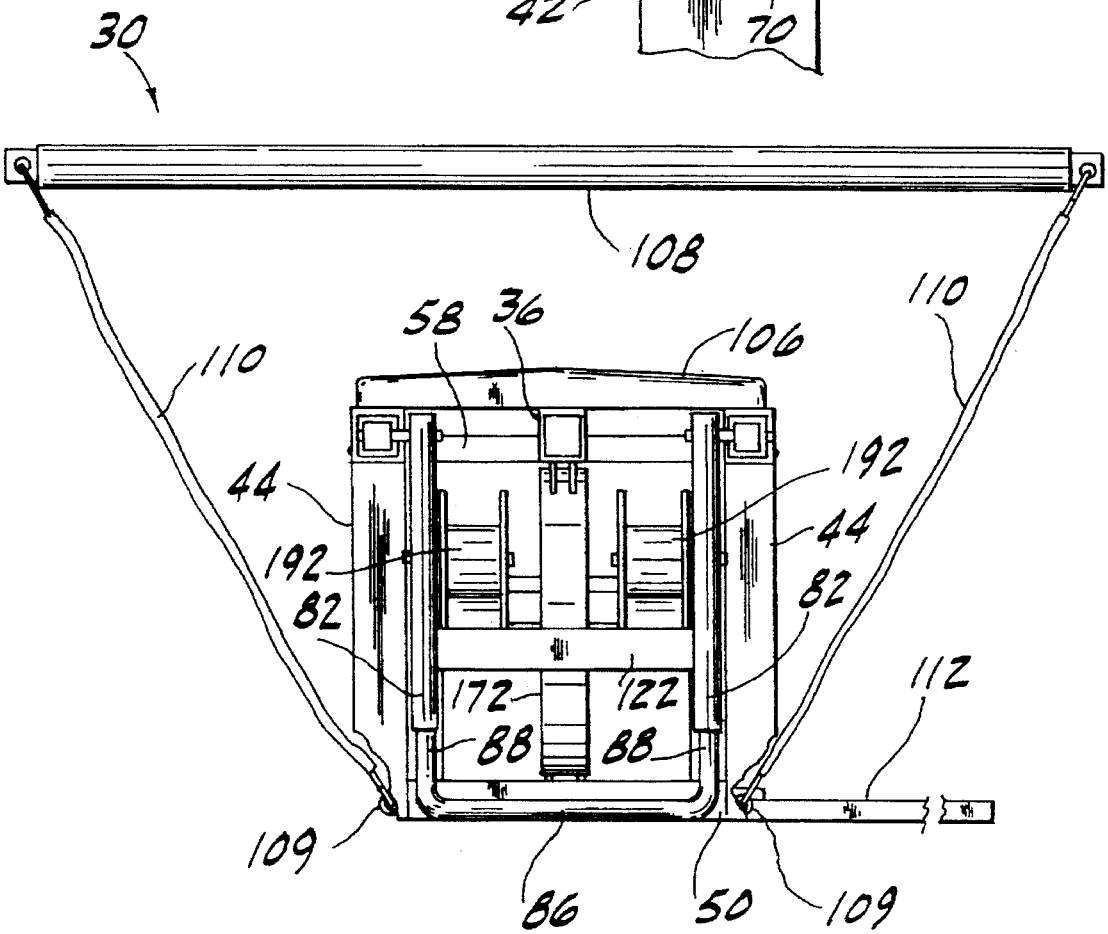
FIG. 5 is a rear end view of the exercise machine of FIG. 1 in its weight bench mode.

The exercise machine 30 is shown in FIGS. 4 and 5 in a weight bench mode. When the exercise machine 30 is in its weight bench mode, the second part 92 of the foldable structure 38 functions as legs for supporting the first part 90 of the foldable structure 38. A resilient elongate pad 102 is fixedly mounted on an intermediate portion of the elongate support 36 and has a surface 104 which faces upwardly when the elongate support is in its generally horizontal position. A resilient short pad 106 is releasably mounted on the outer tubes 72 of the foldable structure 38 and lies generally in the same plane as the elongate pad. Preferably, the elongate and short pads 102, 106 each comprise a thin board, a resilient foam material on the board, and a vinyl covering. The short pad is preferably secured to the outer tubes 72 via mateable hook and loop type fasteners. The pads 102, 106 support a user performing weight lifting exercises when the exercise machine 30 is operated in its weight bench mode.

As shown in FIG. 5, a telescoping rod 108 is connectable to eye bolts 109 fastened to the base structure 34 via resilient straps 110. The rod 108 functions as a weight training bar when the exercise machine 30 is operated in the weight bench mode. A platform 112 (FIG. 5) is releasably connected via suitable hinges adjacent one of the channels 46. The platform 112 is adapted to be pivoted between a generally horizontal position (FIG. 5) and a vertical position (not shown). In the vertical position, the platform 112 covers one side of the exercise machine 30. The platform 112 has a plurality of eye bolts (not shown) adapted to engage hooks on the resilient straps 110. The rod 108 may be connected to the eye bolts by straps 110 or by other straps so that a user can stand on the platform and perform several weight lifting exercises such as, squats, military presses, arm curls, etc. Although the exercise machine 30 is shown having only one platform 112, it is to be understood that a second platform could be releasably connected to the other channel 46.

Figure 9:
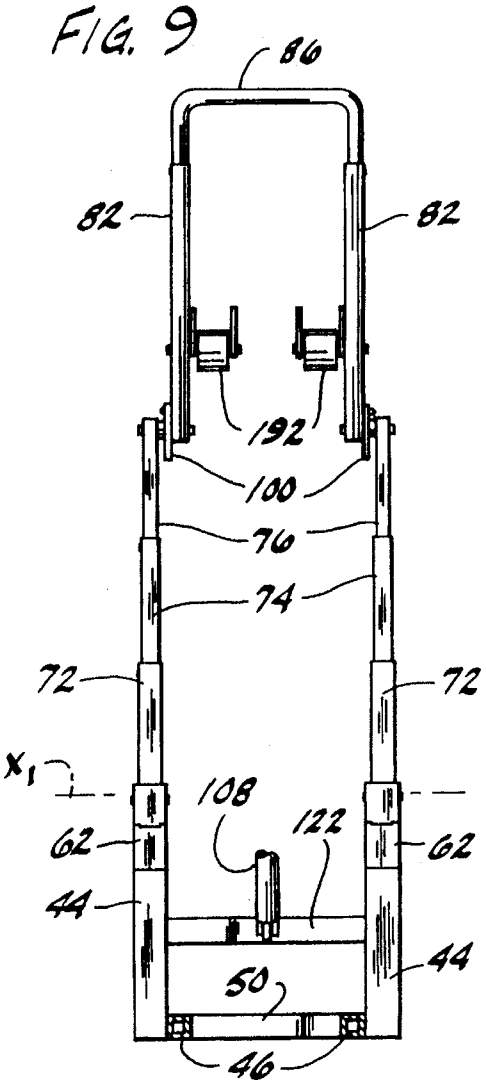
FIG. 9 is a cross-sectional view taken along the plane of lone 9—9 of FIG. 7.
Figure 8:
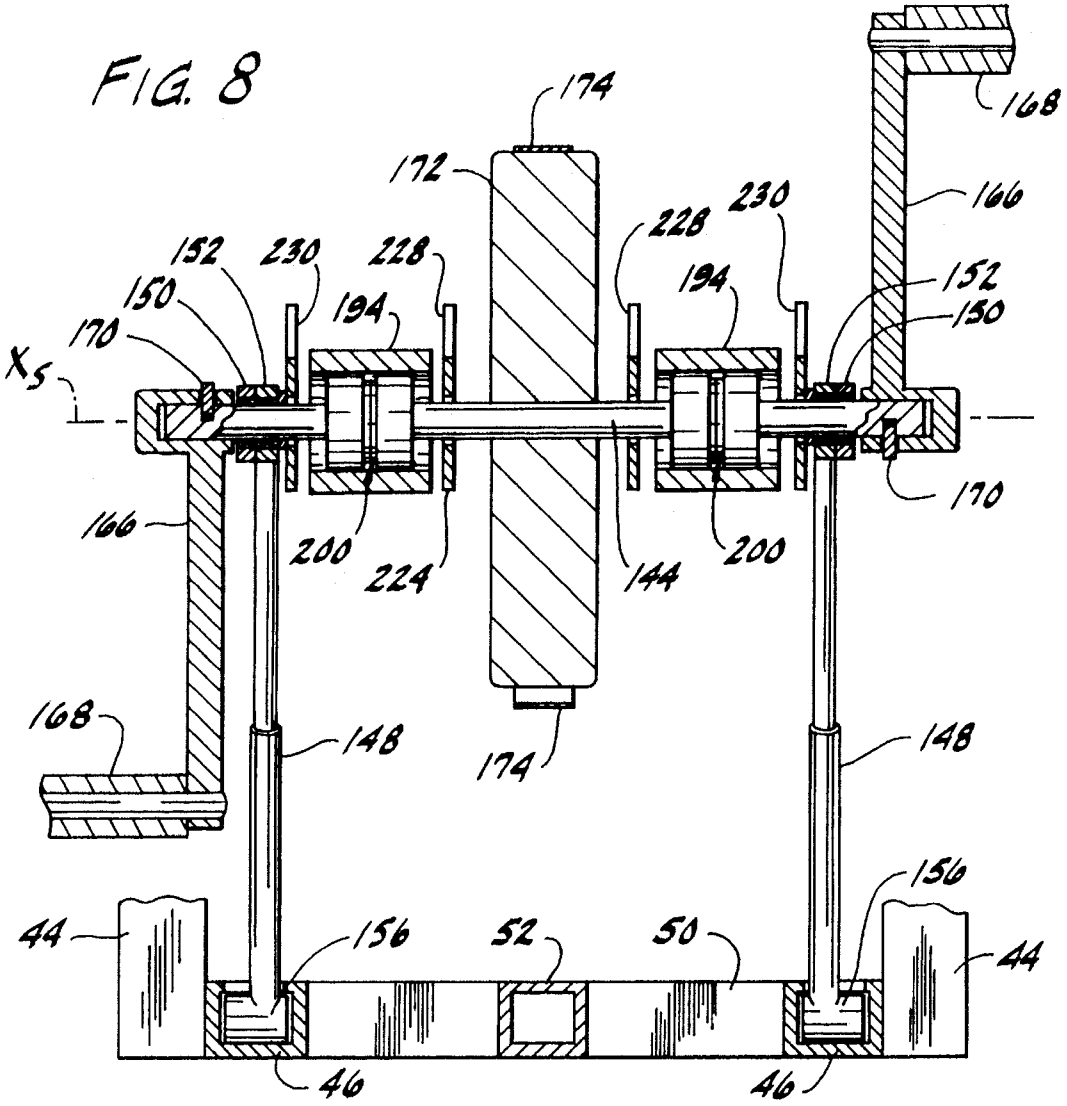
FIG. 8 is a cross-sectional view taken along the plane of line 8—8 of FIG. 7.

The exercise machine 30 is shown in FIGS. 7–9 in a cycling mode for simulating a cycling activity. In the cycling mode, the elongate support 36 is in its upright position. The rod 108 is connected at one end to a flange 118 secured to the elongate support 36 and connected at its other end to a flange 120 secured to the rear posts 44 via a cross-member 122 to brace the elongate support in its upright position. A saddle 124 is releasably mounted on the free end 60 of the elongate support 36 to support a user when the exercise machine 30 is operated in the cycling mode. Preferably, a tubular member 126 extends downward from an underside of the saddle 124 and into a socket 128 defined by the free end 60 of the elongate support 36. The tubular member 126 may be locked in any one of several telescopic positions to adjust the height of the saddle 124. Preferably, height adjustment is made by a removable locking pin 130 adapted to extend through a hole 132 in the elongate support 36 and any one of several apertures (not shown) through the tubular member 126.

The telescoping tubes 72, 74, 76 extend upward and are preferably fully telescoped when the exercise machine 30 is operated in its cycling mode. Preferably, a lock button 134 at a lower part of each middle tube 74 mates with a hole 136 in an upper part of the corresponding outer tube 72 and a lock button 138 at a lower part of each inner tube 76 mates with a hole 140 in an upper part of the corresponding middle tube 74 to releasably lock the telescoping tubes in their fully telescoped positions. Lock buttons 142 are also on each arm 88 of the U-shaped tubular member 86 for engaging openings at the upper ends of the sleeves to releasably lock the U-shaped tubular member in a fully telescoped position. The U-shaped tubular member 86 of the second part 92 functions as handlebars when the exercise machine 30 is operated in the cycling mode.

The exercise machine 30 further includes a horizontal shaft 144 supported by pairs of forward and rear telescoping arms 146, 148. Retaining rings 150, 152 are welded or otherwise joined to the upper ends of the telescoping arms 146, 148. The shaft 144 is journaled in the retaining rings 150, 152 by suitable bearings for rotation of the shaft 144 about a horizontal shaft 144 axis $X_s$. Forward and rear slider members 154, 156 (FIGS. 2 and 8) at the lower ends of the forward and rear telescoping arms 146, 148, respectively, are configured for sliding along the channels 46. Lock pins 158, 160 are removably inserted both through lateral holes 162, 164 in the channels 46 and holes (not shown) in the slider members 154, 156 which are aligned with the holes in the channels 46. The lock pins 158, 160 lock the slider members 154, 156 to the channels 46 to prevent movement of the telescoping arms relative to the channels. A pair of conventional cranks 166 are connected to opposite ends of the shaft 144 for rotating the shaft about the shaft axis $X_s$. Foot pedals 168 are connected to the cranks 166 for enabling a user to turn the cranks with his/her feet. Each crank 166 is preferably splined to the shaft 144 so that the cranks are able to rotate the shaft but may be easily slid on and off the shaft. Preferably, spring biased pins 170 in the cranks 166 are adapted to extend into holes in the shaft 144 to releasably flock the cranks to the shaft. The pins 170 are offset 180 degrees apart so that the cranks are offset 180 degrees.

A flywheel 172 is keyed to the shaft 144 and rotatable therewith. A brake strap 174 is engageable with the periphery of the flywheel 172 to resist rotation of the flywheel and shaft 144. The brake strap 174 is connected at one end to the intermediate beam 52 of the bottom portion 40 of the frame 32 via an inverted U-shaped connector 176. The brake strap 174 extends generally clockwise (as viewed in FIG. 7) around the periphery of the flywheel 172, back through the U-shaped connector 176, around a pulley 178 connected to the forward post 42, and extends upward to a conventional tensioning mechanism, generally indicated at 180. The tensioning mechanism 180 comprises a hand screw 182 threadably mounted through a nut 184 attached to the intermediate portion of the elongate support 36. The lower end of the hand screw 182 is connected via a spring 186 to the brake strap 174. Preferably, another spring 188 connects the other end of the brake strap 174 to the U-shaped connector 176. The springs 186, 188 minimize slack in the brake strap 174. Turning of the hand screw 182 varies the tension of the brake strap 174 to vary the force of friction between the flywheel 172 and brake strap.

Figures 10, 13:
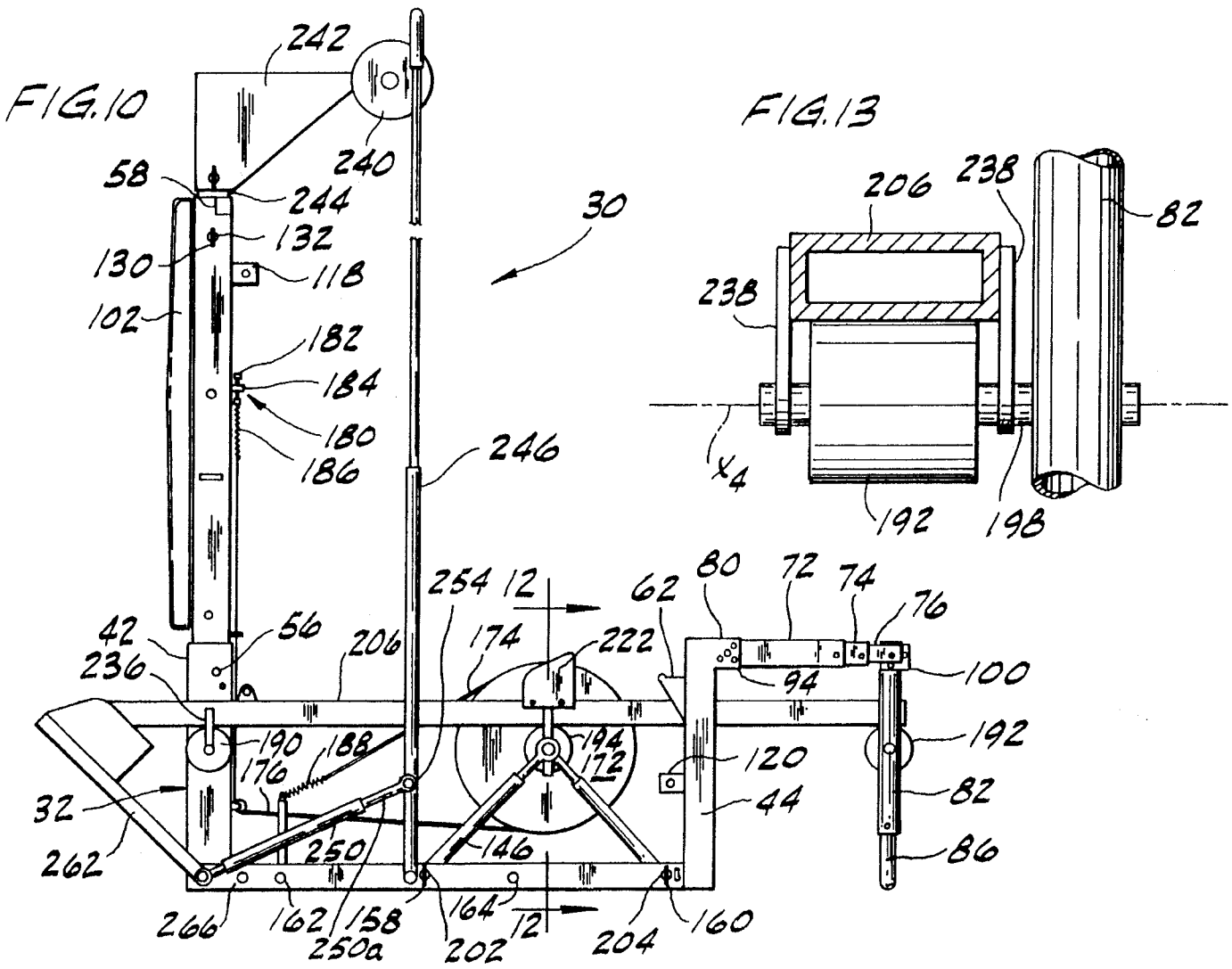
FIG. 10 is a side elevational view of the exercise machine of FIG. 1 transformed into a skier mode for simulating a skiing activity.
FIG. 13 is a fragmented rear elevational view in partial section showing a runner on a rear idler roller of the exercise machine.
Figure 11:
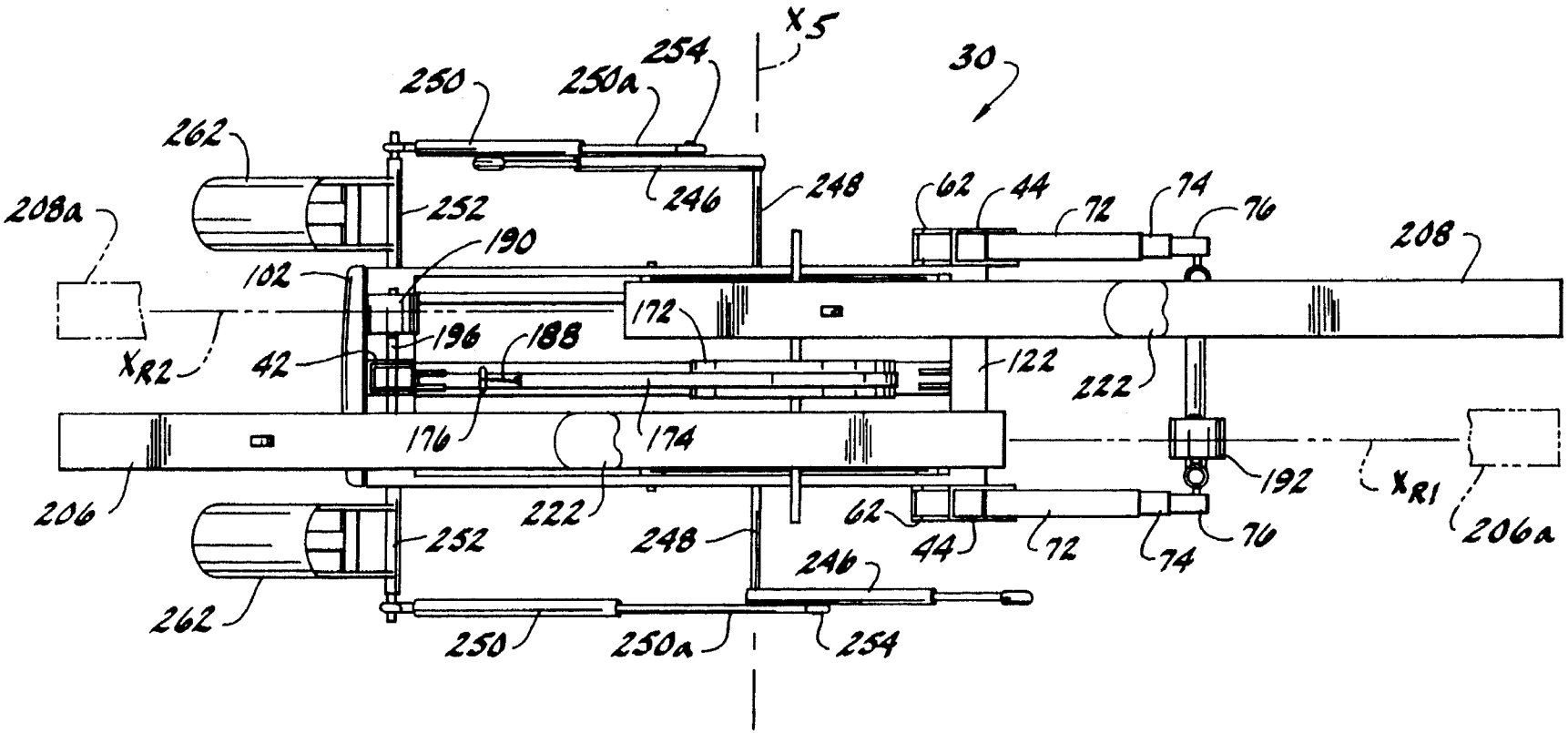
FIG. 11 is a top plan view of the exercise machine of FIG. 10 in its skier mode.
Figure 12:
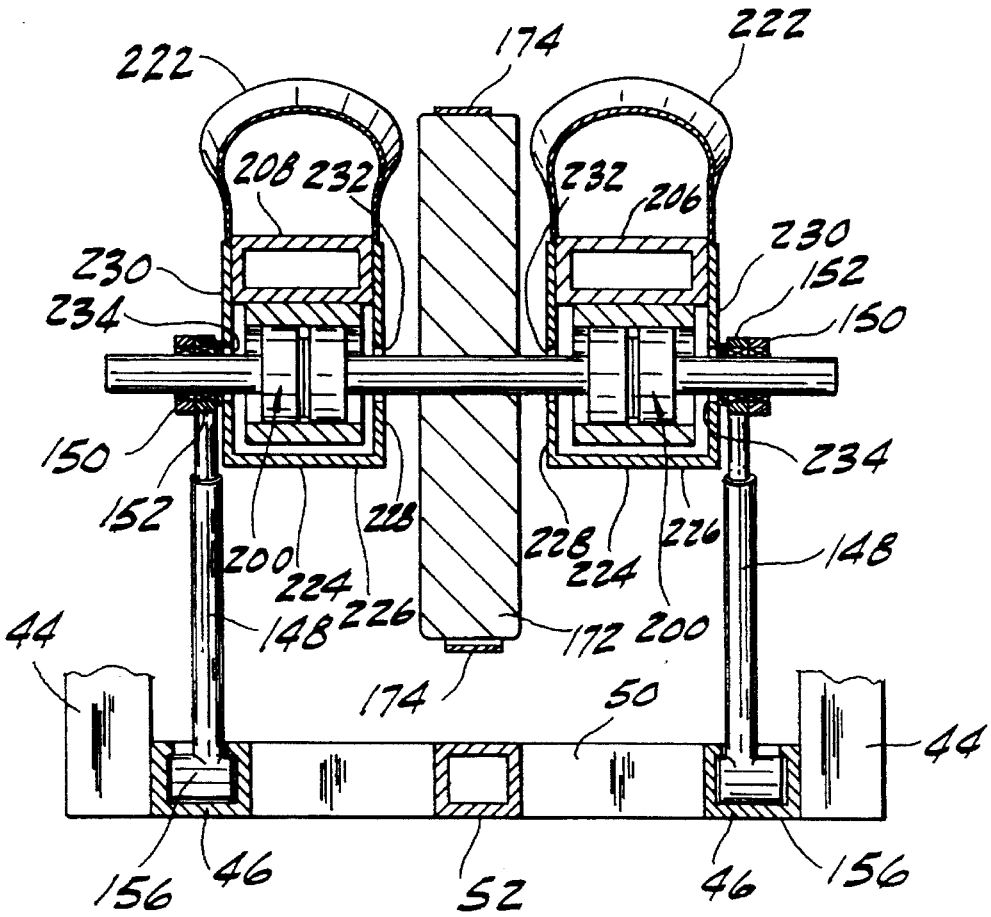
FIG. 12 is a cross-sectional view taken along the plane of line 12—12 of FIG. 10.

Referring now to FIGS. 10–12, the exercise machine 30 is also transformable into a skier mode to simulate a cross-country skiing activity. The foldable structure 38 is positioned in substantially the same position in the skier mode as it is in the bench mode. However, the short pad 106 is removed from the outer tubes 72 of the foldable structure 38 when the exercise machine 30 is in the skier mode. The exercise machine 30 has forward idler rollers 190, rear idler rollers 192, and drive rollers 194. The forward idler rollers 190 (FIGS. 10 and 11) are mounted on a shaft 196 fixed generally at its midpoint to the forward post 42 for supporting the forward idler rollers for rotation about a horizontal axis $X_3$ (FIG. 2). The rear idler rollers 192 (FIGS. 11 and 13) are mounted on laterally extending pins 198 secured to the sleeves 82 of the foldable structure 38 for rotation of the rear idler rollers about a horizontal axis $X_4$ (FIG. 2). The drive rollers 194 are connected to the shaft 144 through one-way clutches, shown schematically at 200 (FIG. 12) for rotation about the shaft axis $X_s$. Although the drive rollers 194 are described as rotating about the same axis as the shaft 144, it is to be understood that the drive rollers could alternatively rotate about a different axis and be connected to the shaft by a suitable drive mechanism. The one-way clutches 200 may be of any suitable one-way clutch which permits the drive rollers 194 to drive the shaft individually, but only when the drive rollers are driven in a first direction (i.e., clockwise as viewed in FIG. 10).

When the exercise machine 30 is operated in the skier mode, the telescoping arms 146,148 are fully retracted and the slider members 154, 156 are positioned in the channels 46 so that the drive rollers 194 are generally midway between the forward and rearward idler rollers 190, 192 and so that top portions of all rollers lie in a single horizontal plane. Holes (not shown) in the slider members 154 of the forward telescoping arms 146 are aligned with holes 202 in the channels 46 and holes (not shown) in the slider members 156 of the rear telescoping arms 148 are aligned with holes 204 in the channels. The slider members are releasably locked to the channels 46 in this position via the lock pins 158, 160.

Figure 14:
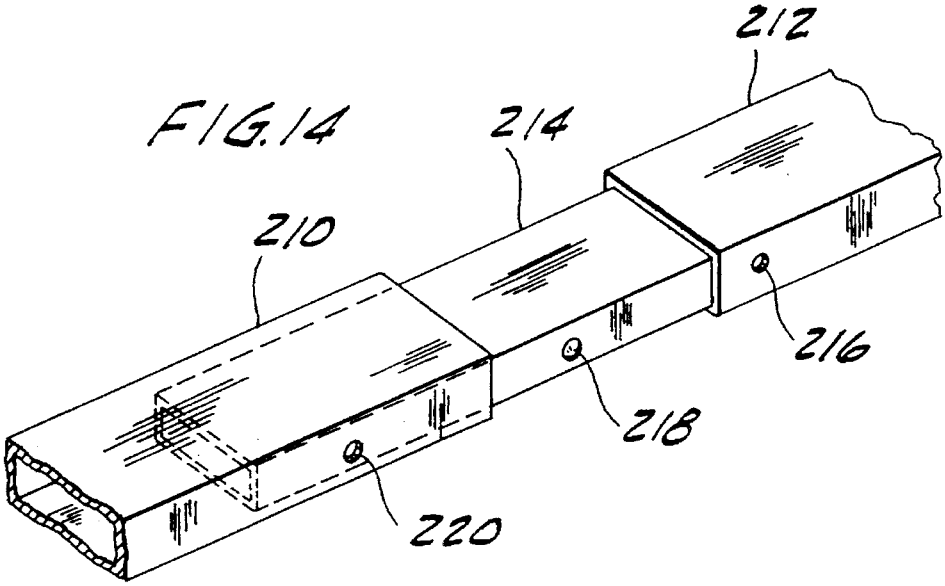
FIG. 14 is a fragmented perspective view showing two tubular sections joined end to end by a splice to form a runner.

The exercise machine 30 further includes first and second elongate members 206, 208 each having a longitudinal axis $X_{R1}$, $X_{R2}$ (FIG. 11). As shown in FIG. 14, each elongate member 206, 208 comprises first and second tubular sections 210, 212 joined end to end by a splice 214. The splice 214 is sized and shaped for a snug telescoping fit within adjacent open ends of the tubular sections. The splice 214 is fixed to the second tubular section 212 by screws 216. Alternatively or in addition, the splice 214 may be bonded to the second tubular section 212 with a suitable adhesive. The first tubular section 210 is releasably connected to the splice 214 by a lock button 218 on the splice adapted to extend through a hole 220 in the first tubular section. The tubular sections 210, 212 are preferably of a suitable synthetic resinous material. The elongate members 206,208 function as runners when the exercise machine 30 is operated in the skier mode and must be sufficiently rigid to resist bowing during operation. Conventional bindings 222 are releasably secured to the runners 206, 208 to secure the feet of the user to the runners.

Each runner 206, 208 is engageable with one of the forward idler rollers 190, one of the rearward idler rollers 192, and one of the drive rollers 194. The runners 206, 208 and rollers 190, 192, 194 are configured for linear reciprocating movement of the runners in a generally horizontal plane along the longitudinal axes $X_{R1}$, $X_{R2}$ of the runners. Preferably, the longitudinal axes $X_{R1}$, $X_{R2}$ are parallel. As shown in FIG. 11, the first (left) runner 206 is movable between a forward position (shown in solid) and a rearward position (denoted by a rearward portion 206*a* of the left runner shown in phantom). The second (right) runner 208 is movable between a rearward position (shown in solid in FIG. 11) and a forward position (denoted by a forward portion 208*a* of the right runner shown in phantom). Rearward movement of either runner 206 or 208 about its longitudinal axis (i.e., movement from left to right as viewed in FIG. 11) causes clockwise rotation of its corresponding drive roller 194 about the shaft axis $X_s$. When one of the drive rollers 194 is rotated in the clockwise direction, its corresponding clutch 200 effects driving engagement between the drive roller and shaft 144. Thus, clockwise rotation of either drive roller 194 causes clockwise rotation of the shaft 144 and flywheel 172. Forward movement of either runner causes counterclockwise rotation of its corresponding drive roller. When one of the drive rollers 194 is rotated in the counterclockwise direction, its corresponding clutch effects driving disengagement between the drive roller and the shaft 144. In other words, each drive roller 194 is free wheeling when rotated in the counter-clockwise direction to rotate independently of the shaft 144 and flywheel 172.

U-shaped guide members 224 are secured to inner sides of the telescoping arms, generally adjacent the drive rollers 194. Each guide member 224 has a generally horizontal center portion 226 and inner and outer leg portions 228,230 extending upward from the center portion. The outer leg portions 230 are preferably welded or otherwise securely joined to the retaining rings 152 of the rear telescoping arms 148. Aligned holes 232, 234 are provided through the inner and outer leg portions 228, 230, respectively, for passage of the shaft 144. The guide members 224 prevent lateral movement of the runners 206,208 as the runners 206, 208 are moved between their forward and rearward positions. Forward guide fingers 236 are secured to and extend upward from the fixed shaft 196 on opposite sides of each forward idler roller 190. Rear guide fingers 238 are fixed to and extend upward from the laterally extending pins 198 on opposite sides of each rear idler roller 192. These guide fingers 236, 238, like the guide members 224, prevent lateral movement of the runners 206, 208 as they are moved forward and rearward on the rollers.

A cylindrical pad 240 is releasably mounted on the free end 60 of the elongate support 36 via a pad support 242 to restrain forward movement of a user operating the exercise machine 30 in the skier mode. Preferably, the cylindrical pad 240 is positioned to engage the hips of a user. The pad support 242 includes a tubular member 244 extending down into the socket 128 at the free end of the elongate support 36. The tubular member 244 may be locked in any one of several telescopic positions to adjust the height of the pad 240. Preferably, height adjustment is made by the removable pin 130 adapted to engage the aperture 132 through the elongate support 36 and any one of several apertures (not shown) through the tubular member 244.

Telescoping poles 246 are releasably connected to the channels 46 of the base structure 34 via suitable laterally extending pin connectors 248 (FIG. 11). The poles 246 extend generally upward from the pin connectors 248 and pivot on the connectors about a generally horizontal axis $X_5$. The poles 246 function as ski poles when the exercise machine 30 is operated in the ski mode. Spring return pneumatic cylinders 250 are pin-connected adjacent forward ends of the channels 46 via connectors 252. The piston rods 250*a* of the pneumatic cylinders 250 are pin-connected at 254 (FIGS. 10 and 11) to the poles 246. The pneumatic cylinders 250 resist rearward movement of the poles 246. Preferably, the resistance force of the pneumatic cylinders 250 may be adjusted to adjust resistance to the poles 246.

Figure 17:
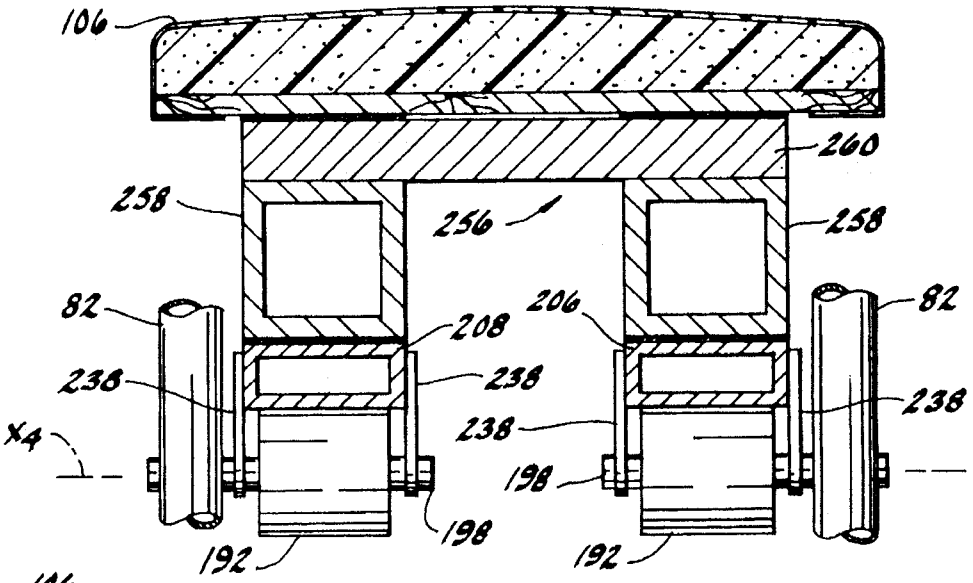
FIG. 17 is a cross-sectional view taken along the plane of line 17—17 of FIG. 16.
Figure 15:
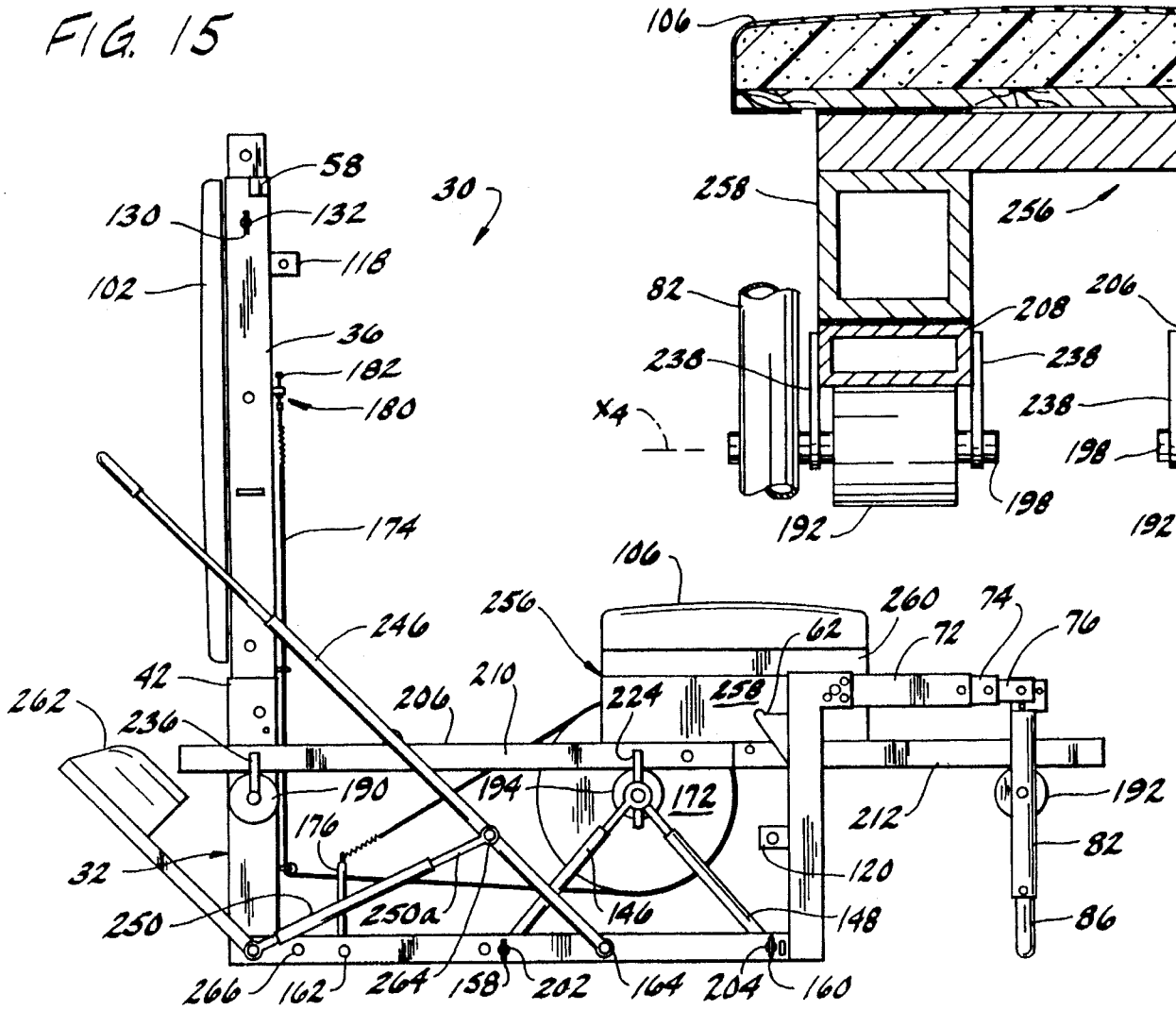
FIG. 15 is a side elevational view of the exercise machine of FIG. 1 transformed into a rower mode for simulating a rowing activity.
Figure 16:
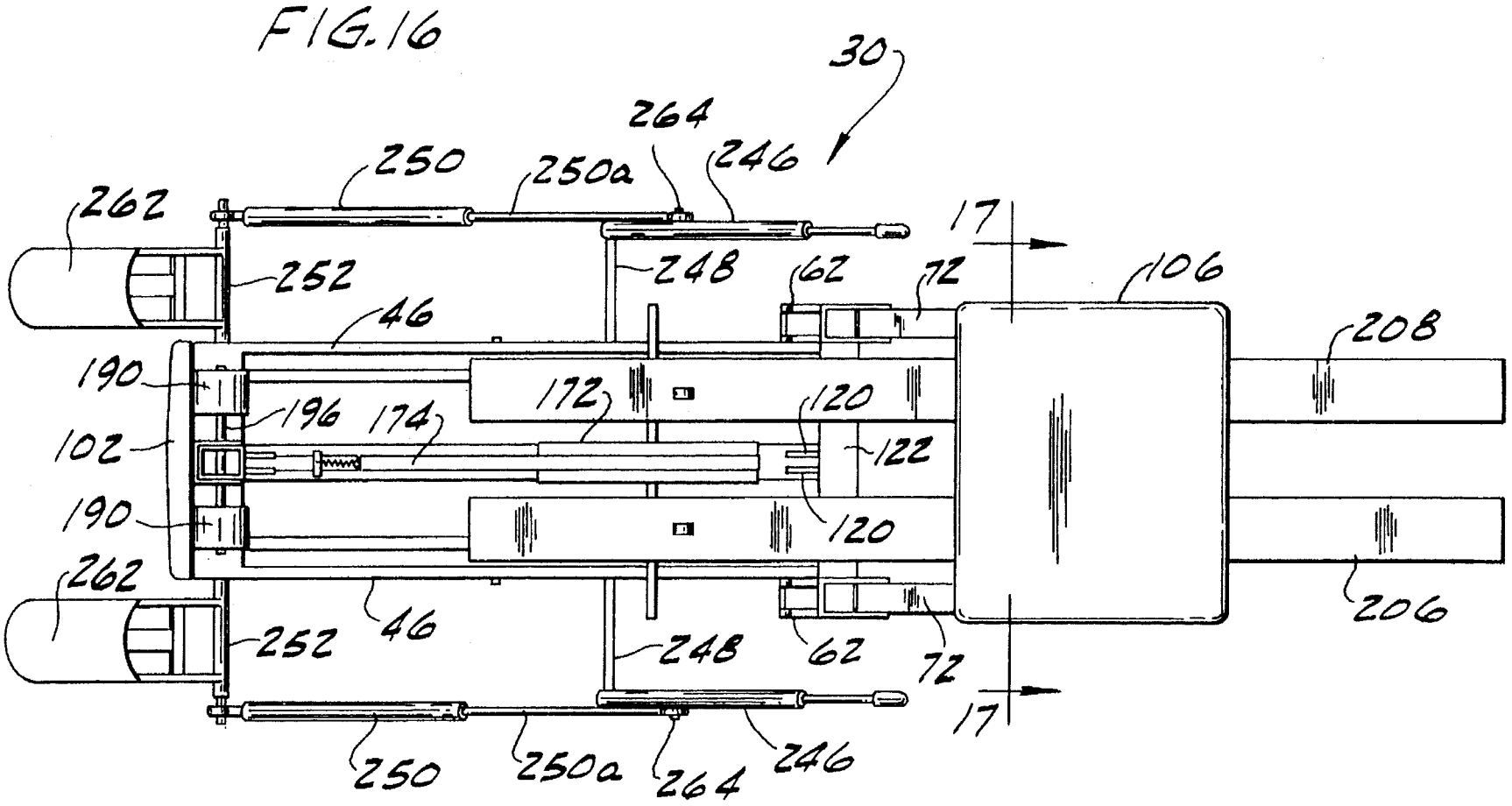
FIG. 16 is a top plan view of the exercise machine of FIG. 15 in its rower mode.

Referring now to FIGS. 15–17, the exercise machine 30 is also operable in a rowing mode to simulate a rowing activity. In the rowing mode, the runners 206,208 are joined by a seat support, generally indicated at 256. The seat support 256 (FIG. 17) has two spaced apart box-shaped members 258 and a board 260 spanning the two members. Preferably, the box-shaped members 258 and board 260 are formed of a suitable rigid synthetic resinous material. Although the seat support 256 is shown and described as being formed of three pieces, it is to be understood that the seat support could be formed as a single unitary piece. Preferably, the seat support 256 is releasably joined to the runners 206, 208 by hook and loop type fasteners secured to upwardly facing surfaces of the runners and to downwardly facing surfaces of the box-shaped members 258. The seat support 256 constitutes means for locking the runners 206, 208 together so that the runners move together. The runners 206, 208 are moveable together in a generally horizontal plane between a forward position (FIG. 15) and a rearward position (FIG. 16). It is to be understood that the seat support 256 is configured for clearing the flywheel 172 as the runners 206, 208 are moved between their forward and rearward positions. The short pad 106 is releasably secured to an upwardly facing surface of the board 260 via mateable hook and loop type fasteners or by any other suitable type of fastener. The weight of a user sitting on the short pad 106 helps maintain connection of the short pad to the seat support 256 and connection of the seat support to the runners 206, 208.

Foot restraints 262 are releasably connected adjacent the forward ends of the channels 46 via the connectors 252. The foot restraints secure the feet of a user to the frame when the exercise machine 30 is operated in the rowing mode. The poles 246 are retracted when the exercise machine 30 is operated in the rowing mode to simulate the motion of oars. Also, the piston rods 250*a* of the pneumatic cylinders 250 may be pin-connected at locations further up the shaft of the poles 246 (e.g., at 264) to increase the effective resistance of the pneumatic cylinders.

Figure 18:
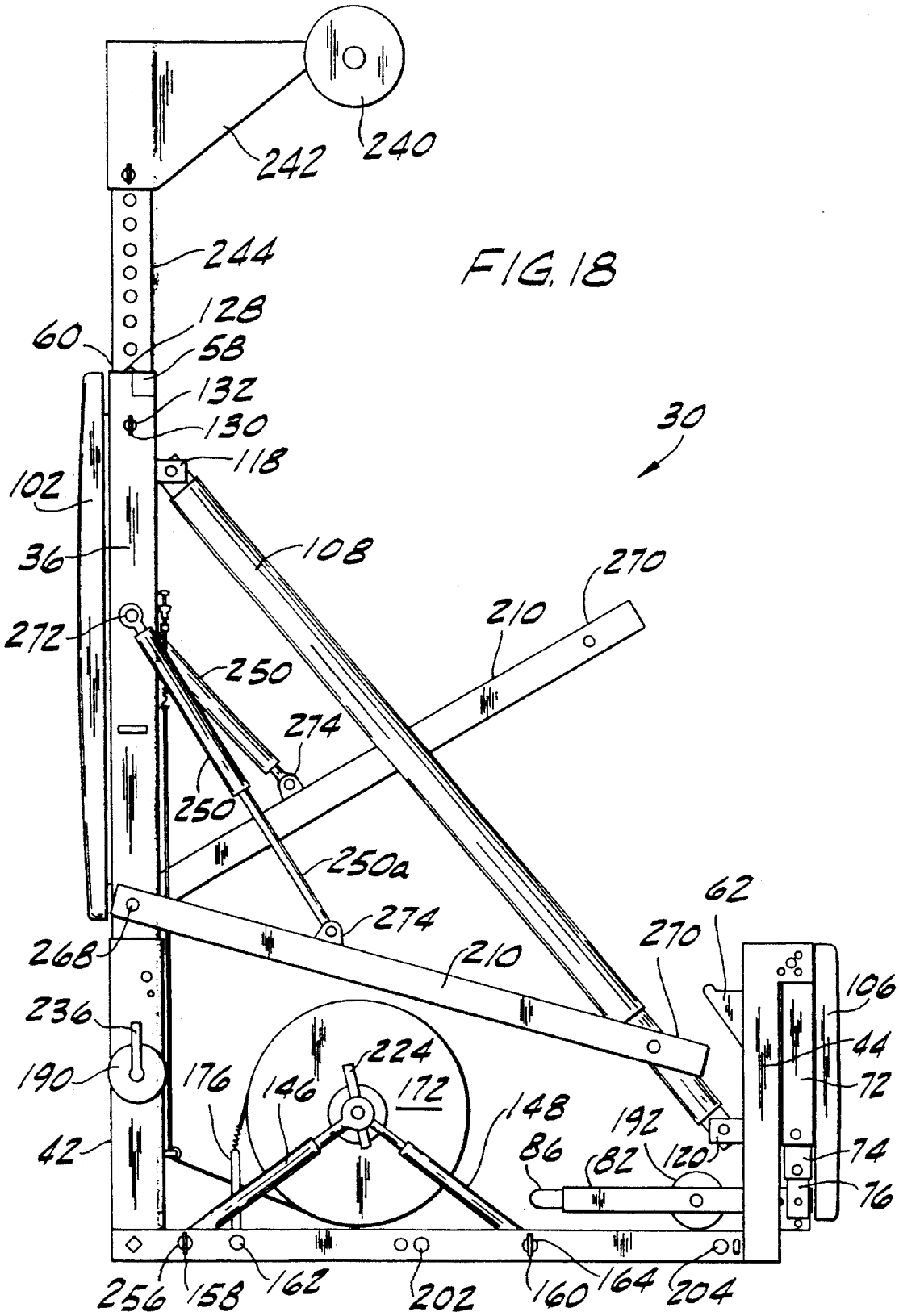
FIG. 18 is a side elevational view of the exercise machine of FIG. 1 transformed into a stair stepper mode for simulating climbing steps.
Figure 19:
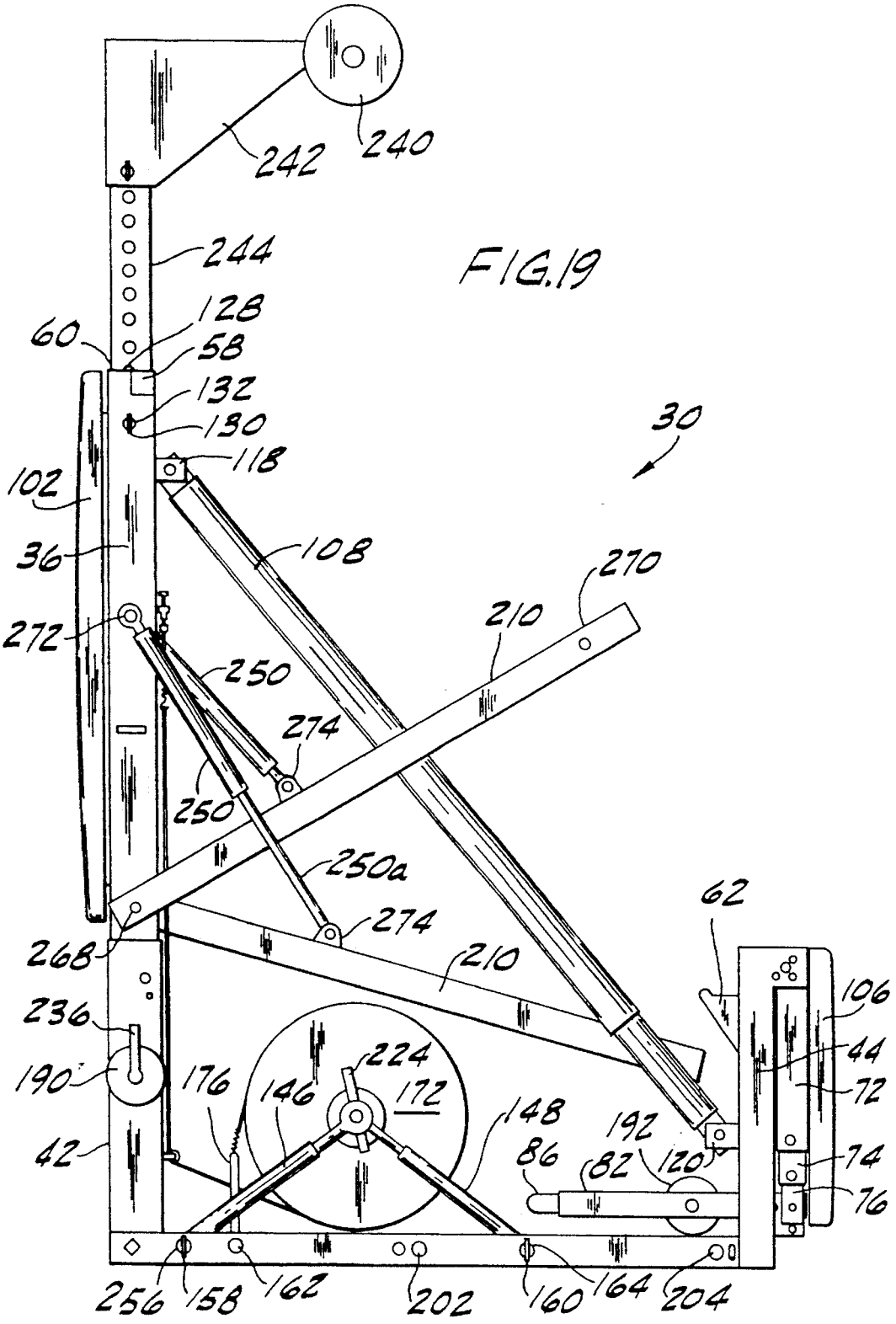
FIG. 19 is a side elevational view similar to that of FIG. 18 but with its left step raised and its right step lowered.

Referring to FIGS. 18 and 19, the exercise machine 30 is further operable in a stair stepper mode to simulate climbing steps. In the stair stepper mode, the flywheel 172 is not used and is moved forward by sliding the slider members 154, 156 forward in the channels 46. The holes in the slider members 154 of the forward telescoping arms 146 are aligned with holes 266 in the channels 46 and the holes in the slider members 156 of the rear telescoping arms 148 are aligned with holes 164. The slider members are locked to the channels 46 by lock pins 158 and 160. The first tubular sections 210 of the elongate members 206,208 are disconnected from the splices 214 and function as steps when the exercise machine 30 is operated in the stair stepper mode. The steps 210 are releasably pin-connected at 268 to a lower portion of the elongate support 36 for movement of the steps about a horizontal axis between raised and lowered positions. In FIG. 19, the left step is shown in its raised position and the right step is shown in its lowered position. In FIG. 18, the left step is shown in its lowered position and the right step is shown in its raised position. The portions of the upper surfaces of the steps 210 adjacent the free ends of the steps constitute stepping surfaces 270. Hook or loop material (not shown) on the stepping surfaces 270 provides traction to prevent a user's feet from slipping off the steps 210. The pneumatic cylinders 250 are releasably pin-connected at 272 to the intermediate portion of the elongate support 36. The piston rods 250*a* of the cylinders 250 are releasably pin-connected to a bracket 274 fixed to the upwardly facing surfaces of the steps 210. The pneumatic cylinders 250 bias the steps 210 in their raised positions and resist movement of the steps in a downward direction. The pneumatic cylinders 250 constitute means for resisting movement of the steps 210 from the raised positions to the lowered positions.

In the stair stepper mode, the cylindrical pad 240 functions as handles which a user may grasp when operating the exercise machine 30. The height of the cylindrical pad 240 may be adjusted to suit the user.

Initially, the exercise machine 30 is in its compact mode (FIGS. 1–3) with the elongate support 36 in its horizontal position, with the first part 90 of the foldable structure 38 (i.e., the parallel sets of telescoping tubes 72, 74, 76) extending downward from the flanges of the rear posts 44, and with the second part 92 of the foldable structure 38 (i.e., the sleeves 82 and U-shaped tubular member 86) extending forward of the first part 90 and under the elongate pad 102.

To transform the exercise machine 30 to the weight bench mode, the first part 90 of the foldable structure 38 is pivoted counterclockwise as viewed in FIGS. 1 and 4 to a position in which the short pad 106 is generally horizontal and lies generally in the same plane as the elongate pad, and the second part 92 of the foldable structure 38 functions as legs to support the first part 90 in the horizontal position. In the weight bench mode, a user may use the weight training bar with the straps 110 to perform various weight training exercises. Alternatively, the user could use the weight bench with free weights.

To transform the exercise machine 30 from the weight bench mode to the cycling mode, the elongate support 36 is first pivoted counterclockwise as viewed in FIGS. 4 and 7 to its upright position and held in this position by the rod 108. The saddle 124 is placed on the free end 60 of the elongate support 36. Next, the short pad 106 is removed from the first part 90 of the foldable structure 38. The telescoping tubes 72, 74, 76 are then pivoted counterclockwise (as viewed in FIG. 7) relative to the rear posts 44 and the sleeves 82 are pivoted counterclockwise relative to the telescoping tubes so that the telescoping tubes, sleeves and U-shaped tubular member all lie in a generally vertical plane. The tubes 72, 74, 76 and U-shaped tubular member 86 are then extended to provide the U-shaped tubular member at a height desired by the user for functioning as handlebars. The flywheel 172 is moved to its desired location by rearwardly moving the slider members 154 of the forward telescoping arms 146 in the channels 46 to align the slider members with holes 162 and by extending the telescoping arms to raise the flywheel. The cranks 166 and foot pedals 168 are then connected to the shaft 144 of the flywheel 172. The distance between the saddle 124 and the foot pedals may be varied by adjusting the height of the saddle and/or by adjusting the height of the flywheel 172.

To operate the exercise machine 30 in the cycling mode, a user sits on the saddle 124 and faces rearwardly, places his/her feet on the foot pedals, and turns the pedals to rotate the flywheel 172 clockwise. The tension of the brake strap 174 may be varied by turning the hand screw 182 to increase or decrease the effort required to rotate the flywheel 172.

To transform the exercise machine 30 from the cycling mode to the skier mode, the foldable structure 38 is moved to substantially the same position as in the bench mode, but the short bench is not attached to the foldable structure. The slider members 154 of the forward telescoping arms 146 are rearwardly moved for alignment with holes 202 and locked in place with lock pins 158, the slider members 156 of the rear telescoping arms 148 are moved rearward for alignment with holes 204 and locked in place with lock pins 160, and the telescoping arms are retracted so that top portions of all rollers lie in a single horizontal plane. The runners 206,208 are placed on the rollers within the guide members 224 and guide fingers 236, 238. The poles 246 are pivotally connected to the channels 46 and the pneumatic cylinders 250 are connected to the poles and channels 46. Although not used in the skier mode, the foot restraints 262 may also be connected to the channels 46 to provide a simpler transformation between the skier and rower modes. The saddle 124 is replaced with the cylindrical pad 240 and pad support 242 and the height of the cylindrical pad is adjusted so that the cylindrical pad contacts the hip of a user standing on the runners 206, 208.

To operate the exercise machine 30 in the skier mode, the user places his/her feet in the bindings 222 and places his/her hips against the cylindrical pad 240. The user will then move his/her feet back and forth to move the runners 206, 208 between their forward and rearward positions to simulate a cross-country skiing activity. When one of the runners 206, 208 is rearwardly moved, the underside of the runner will turn its corresponding drive roller in clockwise direction to turn the flywheel 172 via the clutch. Rearward movement of each runner is resisted by the brake strap 174. The cylindrical pad 240 will prevent the user from moving forward as the runner is moved rearward. Forward movement of either runner causes its corresponding drive roller to free wheel. Thus, movement and resistance of the runners 206, 208 simulates the movement and resistance of skis in cross country skiing. As the user moves his/her feet back and forth to move the runners 206, 208, he/she also moves the poles 246 back and forth to simulate the pole action of cross-country skiing.

To transform the exercise machine 30 from the skier mode to the rower mode, the bindings 222 are removed from the runners 206, 208 and the seat support 256 is fastened to the upper surface of the runners by the hook and loop type fasteners. The short pad 106 is then placed on the seat support 256 and secured thereto by the hook and loop type fasteners. The telescoping poles 246 are then retracted to accommodate a user sitting on the short pad 106.

During operation in the rower mode, a user sits on the short pad 106, places his/her feet in the foot restraints 262, and grasps the poles 246. The user then bends his/her knees, leans forward to move the runners 206, 208 to the forward position shown in FIG. 15. Forward movement of the runners 206, 208 causes the drive rollers 194 to free wheel. The user then straightens his/her legs and pulls against the poles 246 to move the runners 206, 208 and poles to the rearward positions shown in FIG. 16. Rearward movement of the runners 206,208 causes the flywheel 172 to rotate in clockwise direction. The brake strap 174 resists rearward movement of the runners 206, 208 and the resistance may be varied by adjusting the hand screw 182.

To transform the exercise machine 30 from the rower mode to the stair stepper mode, the flywheel 172 is moved forward (FIG. 18) by sliding the slider members 154, 156 forward in the channels 46 so that the slider members 154 of the forward telescoping arms 146 are aligned with holes 266 in the channels and the slider members 156 of the rear telescoping arms 148 are aligned with holes 164. The first tubular sections 210 of the elongate members 206, 208 are disconnected from the splices 214 and connected to the elongate support 36. The pneumatic cylinders 250 are detached from the poles 246 and channels 46 and connected to the elongate support 36 and steps 210. The springs (not shown) in the pneumatic cylinders 250 bias the steps 210 in their raised positions and resist downward movement of the steps. To operate the exercise machine 30 in the stair stepper mode, a user stands on steps 210 and raises one foot while simultaneously lowering the other to simulate the action of climbing steps.

Thus, the exercise machine 30 is easily transformed into several exercise modes.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An exercise machine operable in a first mode for simulating an activity such as skiing or rowing involving reciprocating linear motion in a generally horizontal plane, and in a second mode for simulating climbing steps, said machine comprising:

a frame;

a pair of elongate members, each having a longitudinal axis;

said elongate members functioning as a pair of runners when the exercise machine is operated in said first mode, the runners being mountable on the frame generally parallel to one another for linear reciprocating movement in a generally horizontal plane along the longitudinal axes of the runners between forward and rearward positions; and at least a part of each of said elongate members functioning as a step when the exercise machine is operated in said second mode, each step having a stepping surface generally adjacent a first end of the step, each step being pivotably connectable to the frame for pivoting about a generally horizontal axis to enable a user to move the stepping surface between raised and lowered positions, and for restricting each step from linear reciprocating movement in the generally horizontal plane along the longitudinal axis of each elongate member, the generally horizontal axis being stationary relative to the frame as the stepping surface is moved between its raised and lowered positions.

2. An exercise machine as set forth in claim 1 further comprising means for resisting movement of the steps from the raised positions to the lowered positions.

3. An exercise machine as set forth in claim 1 further comprising means for resisting rearward movement of the runners along the longitudinal axes of the runners when the exercise machine is operated in said first mode.

4. An exercise machine as set forth in claim 3 wherein said means for resisting rearward movement of the runners comprises:

a shaft operatively connected to the frame for rotation about a shaft axis;

a flywheel secured to the shaft and rotatable therewith;

drive rollers operatively connected to the frame for rotation about a roller axis, the drive rollers being engageable with the runners such that movement of the runners along their longitudinal axes causes rotation of the drive rollers; and one-way clutches operatively connecting the drive rollers to the shaft, each clutch effecting driving engagement between a corresponding one of the drive rollers and the shaft when its corresponding drive roller is rotated in a first direction such that rotation of the drive roller in the first direction rotates the flywheel, each clutch effecting driving disengagement between its corresponding drive roller and the shaft when the drive roller is rotated in a second direction opposite the first direction such that the drive roller is free wheeling when rotated in the second direction to rotate independently of the flywheel.

5. An exercise machine operable in a first mode for simulating an activity such as skiing or rowing involving reciprocating linear motion in a generally horizontal plane and in a second mode for simulating a cycling activity, said machine comprising:

a frame;

a shaft operatively connected to the frame for rotation about a shaft axis;

a flywheel secured to the shaft and rotatable therewith;

an elongate member having a longitudinal axis, said elongate member functioning as a runner when the exercise machine is operated in said first mode, the runner being mountable on the frame for linear reciprocating movement in a generally horizontal plane along the longitudinal axis of the runner between forward and rearward positions;

a drive roller operatively connected to the frame for rotation about a roller axis, the drive roller being engageable with the runner such that rearward movement of the runner along its longitudinal axis causes rotation of the drive roller in a first direction and forward movement of the runner along its longitudinal axis causes rotation of the drive roller in a second direction opposite the first direction;

a one-way clutch operatively connecting the drive roller to the shaft, the clutch effecting driving engagement between the drive roller and shaft when the drive roller is rotated in said first direction such that rotation of the drive roller in the first direction rotates the flywheel, the clutch effecting driving disengagement between the drive roller and shaft when the drive roller is rotated in said second direction such that the drive roller is free wheeling when rotated in the second direction to rotate independently of the flywheel;

a pair of offset cranks operatively connectable to the shaft for rotating the shaft and flywheel about the shaft axis;

a pair of foot pedals connected to the cranks;

the exercise machine being operable in said first mode such that rearward movement of the runner along the longitudinal axis of the runner rotates the drive roller in said first direction to rotate the flywheel and forward movement of the runner along the longitudinal axis of the runner rotates the drive roller in said second direction independent of the rotation of the flywheel; and the exercise machine being operable in said second mode such that rotation of the cranks and shaft via the foot pedals causes rotation of the flywheel.

6. An exercise machine as set forth in claim 5 wherein the roller axis is in-line with the shaft axis.

7. An exercise machine as set forth in claim 5 further comprising means for resisting rotation of the flywheel.

8. An exercise machine as set forth in claim 5 wherein the exercise machine is further operable in a third mode as a weight bench for supporting a user during a weight lifting activity, and wherein the frame includes a base structure and an elongate support, said elongate support having first and second opposite ends and an intermediate portion between the ends, the elongate support being connected at its first end to the base structure for pivoting about a generally horizontal axis between an upright position in which the second end is above the first end and a generally horizontal position, the elongate support being in its upright position when the exercise machine is operated in said second mode and being in its generally horizontal position when operated in said third mode, said machine further comprising:

a saddle mountable on the second end of the elongate support when the support is in its upright position, said saddle being adapted to support a user when the exercise machine is operated in its second mode; and a pad mounted on the intermediate portion of the elongate support and having a surface which faces upwardly when the support is in its generally horizontal position, the support and pad functioning as a weight bench to support a user performing weight lifting exercises when the exercise machine is operated in its third mode.

9. An exercise machine as set forth in claim 5 wherein the elongate member constitutes a first elongate member, the drive roller constitutes a first drive roller, and the one-way clutch constitutes a first one-way clutch, the exercise machine further comprising:

a second elongate member having a longitudinal axis, said second elongate member functioning as a second runner when the exercise machine is operated in said first mode, the second runner being mountable on the frame for linear reciprocating movement in said generally horizontal plane along the longitudinal axis of the runner between forward and rearward positions;

a second drive roller operatively connected to the frame for rotation about the roller axis, the second drive roller being engageable with the second runner such that rearward movement of the second runner along its longitudinal axis causes rotation of the second drive roller in said first direction and forward movement of the second runner along its longitudinal axis causes rotation of the second drive roller in said second direction; and a second one-way clutch operatively connecting the second drive roller to the shaft, the second clutch effecting driving engagement between the second drive roller and shaft when the second drive roller is rotated in said first direction such that rotation of the second drive roller in the first direction rotates the flywheel, the second clutch effecting driving disengagement between the second drive roller and shaft when the second drive roller is rotated in said second direction opposite the first direction such that the second drive roller is free wheeling when rotated in the second direction to rotate independently of the flywheel.

10. An exercise machine as set forth in claim 9 wherein the first runner is moveable independently of the second runner, the exercise machine being operable in said first mode to simulate a cross country ski activity.

11. An exercise machine as set forth in claim 9 wherein the first and second runners are generally parallel when the exercise machine is operated in said first mode.

12. An exercise machine as set forth in claim 11 further comprising means for locking the first runner to the second runner when the exercise machine is operated in said first mode, the runners being moveable together in said generally horizontal plane between their first and second positions.

13. An exercise machine as set forth in claim 12 further comprising a seat adapted to be mounted on the runners for supporting a user, and foot restraints connected to the frame for securing the feet of a user to the frame, the exercise machine being operable in said first mode to simulate a rowing activity.

14. An exercise machine as set forth in claim 9 wherein the exercise machine is further operable in a third mode for simulating climbing steps, at least a part of each of said elongate members functioning as a step when the exercise machine is operated in said third mode, each step having a stepping surface generally adjacent a first end of the step, each step being pivotably connectable to the frame for pivoting about a generally horizontal axis to enable a user to move the stepping surface between raised and lowered positions.

15. An exercise machine as set forth in claim 14 further comprising means for resisting movement of the steps from the raised positions to the lowered positions.

16. An exercise machine as set forth in claim 15 wherein the exercise machine is further operable in a fourth mode as a weight bench for supporting a user during a weight lifting activity, and wherein the frame includes a base structure and an elongate support, said elongate support having first and second opposite ends and an intermediate portion between the ends, the elongate support being connected at its first end to the base structure for pivoting about a generally horizontal axis between an upright position in which the second end is above the first end and a generally horizontal position, the elongate support being in its upright position when the exercise machine is operated in said second mode and being in its generally horizontal position when operated in said fourth mode, said machine further comprising:

a saddle mountable on the second end of the elongate support when the support is in its upright position, said saddle being adapted to support a user when the exercise machine is operated in its second mode; and a pad mounted on the intermediate portion of the elongate support and having a surface which faces upwardly when the support is in its generally horizontal position, the support and pad functioning as a weight bench to support a user performing weight lifting exercises when the exercise machine is operated in its fourth mode.

17. An exercise machine operable in a first mode for simulating a cycling activity, and operable in a second mode as a weight bench for supporting a user during a weight lifting activity, said machine comprising:

a frame;

a shaft operatively connected to the frame for rotation about a shaft axis;

a flywheel secured to the shaft and rotatable therewith;

a pair of offset cranks operatively connectable to the shaft for rotating the shaft and flywheel about the shaft axis;

a pair of foot pedals connected to the cranks;

the frame including a base structure and an elongate support, said elongate support having first and second opposite ends and an intermediate portion between the ends, the elongate support being connected at its first end to the base structure for pivoting about a generally horizontal axis between an upright position in which the second end is above the first end and a generally horizontal position, the elongate support being in its upright position when the exercise machine is operated in said first mode and being in its generally horizontal position when operated in said second mode;

a saddle mountable on the second end of the elongate support when the support is in its upright position, said saddle being adapted to support a user when the exercise machine is operated in its first mode; and a pad mounted on the intermediate portion of the elongate support and having a surface which faces upwardly when the support is in its generally horizontal position, the support and pad functioning as a weight bench to support a user performing weight lifting exercises when the exercise machine is operated in its second mode.

18. An exercise machine as set forth in claim 17 further comprising:

a rod, said rod functioning as a brace when the exercise machine is operated in said first mode, the brace being connectable at one end to the base structure and connectable at its other end to the elongate support to maintain the elongate support in its upright position, said rod functioning as a weight training bar and being detached from the base structure and elongate support when the exercise machine is operated in said second mode;

biasing means attachable to the weight training bar when the exercise machine is operated in said second mode for resisting upward movement of the weight training bar relative to the elongate support.

19. An exercise machine as set forth in claim 17 wherein said frame further includes a foldable structure having first and second parts, said first part being connected to said base structure and said second part being connected to said first part, the second part functioning as handlebars when the exercise machine is operated in said first mode and functioning as legs for supporting the first part when the exercise machine is operated in said second mode.

20. An exercise machine as set forth in claim 19 wherein said pad constitutes a first pad, said exercise machine further comprising a second pad mountable on said first part generally adjacent the first pad.

* * * * *